United States Patent [19]

Lazar

[11] Patent Number: 4,700,809

[45] Date of Patent: Oct. 20, 1987

[54] SCREWLESS ELEVATOR CAR ASSEMBLY

[75] Inventor: Gustav Lazar, Vienna, Austria

[73] Assignee: Otis Elevator Company, Farmington, Conn.

[21] Appl. No.: 853,795

[22] Filed: Apr. 18, 1986

[51] Int. Cl.[4] ..... B66B 11/02

[52] U.S. Cl. ..... 187/1 R; 52/588

[58] Field of Search ..... 187/1 R, 17, 20; 52/79.1, 79.12, 79.9, 588, 578–579; 403/363, 375, D10; 220/4 F

[56] References Cited

U.S. PATENT DOCUMENTS

| | | | |
|---|---|---|---|
| 2,246,732 | 6/1941 | Hymans | 187/1 R |
| 2,648,409 | 8/1953 | Daugherty et al. | 52/588 X |
| 3,371,816 | 3/1968 | Ricci | 220/4 F |
| 3,374,915 | 3/1968 | Verhein et al. | 220/4 F |
| 3,631,942 | 1/1972 | Brounn | 187/1 R |
| 3,759,412 | 9/1973 | Bush | 220/4 F X |
| 4,357,993 | 11/1982 | Halpern et al. | 187/1 R |

FOREIGN PATENT DOCUMENTS

| | | | |
|---|---|---|---|
| 109354 | 4/1968 | Denmark | 187/1 R |

*Primary Examiner*—Joseph J. Rolla
*Assistant Examiner*—Nik E. Pedersen

[57] ABSTRACT

The side panels (60,70), back panel (50), base panel (38), and top panel (80) of an elevator car (26) are assembled via interlocking U-shaped channels disposed along the edges of the panels. The base panel (38) has downward-projecting tabs (48) that fit between two lower cross-members (20,22) of the car frame (10). When the top panel is clamped down on the assembly via brackets (24) on the upper portion of the car frame (10), the entire assembly is rigidized.

2 Claims, 1 Drawing Figure

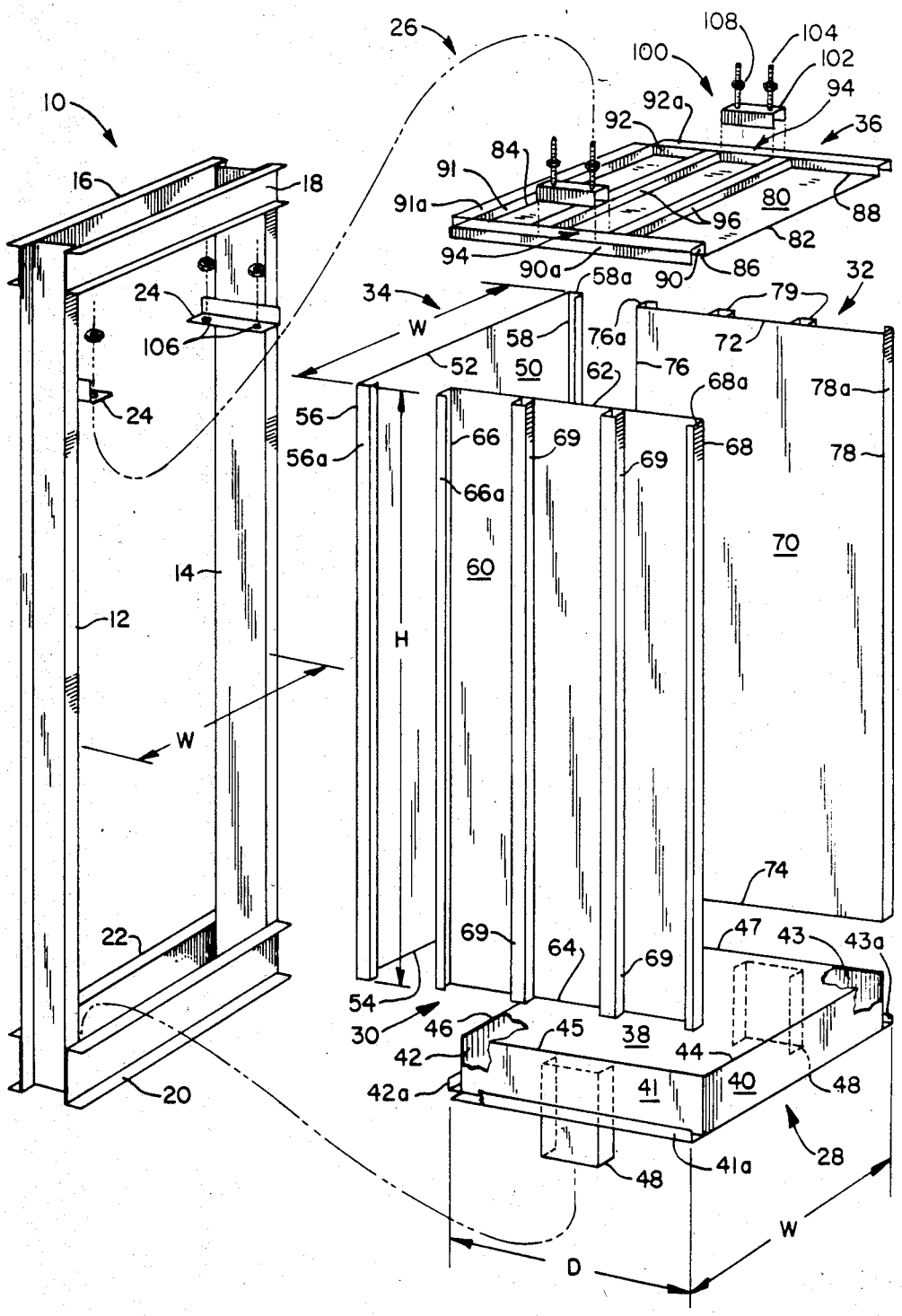
10
16
18
24
106
24
14
12
W
22
20
26
108
104
100
102
94
92a
92
36
84
91
91a
80
88
96
82
94
90a
90
86
58a
34
W
58
76a
79
32
72
52
50
62
76
68a
78a
56
56a
66
69
69
68
78
66a
60
70
H
74
69
64
69
47
43
43a
54
30
46
45
38
44
42
41
40
48
42a
41a
28
48
W
D

SCREWLESS ELEVATOR CAR ASSEMBLY

BACKGROUND OF THE INVENTION

In the event that an elevator car cannot be installed in the hoistway as an assembled unit, it is necessary to assemble it piecemeal in the hoistway. Small clearances between the exterior of the cab and the interior of the hoistway present a problem.

DISCLOSURE OF THE INVENTION

Therefore, it is the object of this invention to provide an elevator car that can be readily erected in the hoistway, almost entirely from inside the car.

According to the invention the side panels, back panel, base panel, and top panel of an elevator car are assembled via interlocking U-shaped channels disposed along the edges of the panels. The base panel has downward-projecting tabs that fit between two lower cross-members of the car frame. When the top panel is clamped down on the assembly via brackets on the upper portion of the car frame, the entire assembly is rigidized.

Other objects, features, and advantages of the invention will become apparent in light of the following description thereof.

BRIEF DESCRIPTION OF THE DRAWINGS

The sole FIGURE herein is an exploded view of the elevator car of this invention.

BEST MODE FOR CARRYING OUT THE INVENTION

The FIGURE shows a rectangular elevator car frame 10 comprising two vertical C-beams 12 and 14 (backs facing each other) spaced apart at the top by two upper C-beams 16 and 18 and spaced apart at the bottom by two lower C-beams 20 and 22, as shown.

Near the top of the two vertical beams 12 and 14, an L-shaped bracket 24 is affixed to each of the vertical beams 12 and 14, projecting into the car frame, as shown.

An elevator car 26 is essentially a rectangular prism. A base 28, two sides 30, 32, a back 34, and a top 36 of the car are described. The remaining side (not shown) would be a door unit.

The base 28 forms the floor of the elevator car 26 and is essentially an open box-like sheet-metal structure having a rectangular upper surface 38 and four sides 40–43 projecting downwardly from the four edges 44–47 of the upper surface 38.

The three sides 41–43 each form one leg of a U-shaped channel 41*a*, 42*a*, 43*a* that projects at a right angle outwardly from the respective side, and thence at a right angle upwardly towards the upper surface 38 a distance, which is less than the height of the corresponding side. The width of the channels is t.

A rigid rectangular tab 48 is also provided substantially at the midpoint of the two opposing sides 41, 43, extending downwardly from beneath the upper surface 38 and beyond the U-shaped channels. The tabs 48 are sized so as to fit snugly within the two lower C-beams 20, 22 of the car frame 10.

The base 28 is sized so as to fit snugly between the two vertical C-beams 12, 14. In other words, its overall width W, equals the space W between the two vertical C-beams 12, 14. Its overall depth is D.

The side 34 forms the back of the car. It is essentially a flat rectangular sheet-metal panel 50 having a top edge 52, a bottom edge 54, two side edges 56, 58, a height H, and an overall width W. Each of the side edges 56, 58 form one leg of a U-shaped channel 56*a*, 58*a* that projects at a right angle towards the car interior from the respective side edge 56, 58 a distance t, and thence at a right angle towards the opposite side edge. The U-shaped channel 56*a* receives the side 30 and the U-shaped side 58*a* receives the side 34, as described hereinafter. The U-shaped channels 56*a*, 58*a* provide regions of thickness t at both ends of the bottom edge 54 of the panel 50 so that the bottom edge 54 of the panel 50 may be fitted snugly into the corresponding U-shaped channel 42*a* of the base 28. They also provide regions of thickness t at both ends of the top edge 52 of the panel 50 so that the top edge 52 of the panel 50 will snugly receive the car top 36, as described hereinafter.

The side 30 is essentially a flat rectangular sheet-metal panel 60 having a top edge 62, a bottom edge 64, two side edges 66, 68, a height H and a depth D. Each of the side edges 66 and 68 form one leg of a U-shaped channel 66*a*, 68*a* that projects at a right angle towards the car exterior from the respective side edge 66, 68 a distance t, and thence at a right angle towards the opposite side edge. The U-shaped channel 66*a* provides a region of increased thickness t along the side edge 66 of the panel 60 so that the side edge 66 of the panel 60 may be fitted snugly into the U-shaped channel 56*a* of the back panel 50. Since nothing is ultimately fitted into the channel 66*a*, it may be solid, or box-section, so long as it provides an appropriate thickness for the fitting-together of the sides 30, 32. The same is generally true of the channel 68*a* which simply provides a convenient mounting surface for the door panel (not shown) of the car 26.

The U-shaped channels 66*a*, 68*b* provide regions of increased thickness t at both ends of the bottom edge 64 of the panel 60 so that the bottom edge 64 of the panel 60 may be fitted snugly into the U-shaped channel 41*a* of the base 28. They also provide regions of increased thickness t at both ends of the top edge 62 of the panel 60 so that the top edge 62 of the panel 60 will snugly receive the car top 36, as described hereinafter.

The side 32 is essentially a flat rectangular sheet-metal panel 70 having a top edge 72, a bottom edge 74, two side edges 76, 78, a height H and a depth D. Each of the side edges 76 and 78 form one leg of a U-shaped channel 76*a*, 78*a* that projects at a right angle towards the car exterior from the respective side edge 76, 78 a distance t, and thence at a right angle towards the opposite side edge. The U-shaped channel 76*a* provides a region of increased thickness t along the side edges 76 of the panel 70 so that the side edge of the panel 70 may be fitted snugly into the U-shaped channel 58*a* of the back panel 50. Since nothing is ultimately fitted into the channel 76*a*, it may be solid, or box-section, so long as it provides an appropriate thickness for the fitting-together of the sides 30, 34. The same is generally true of the channel 78*a* which simply provides a convenient mounting surface for the door panel of the car 26.

The U-shaped channels 76*a*, 78*a* provide regions of increased thickness t at both ends of the bottom edge 74 of the panel 70 so that the bottom edge of the panel 70 may be fitted snugly into the U-shaped channel 43*a* of the base 28. They also provide regions of increased thickness t at both ends of the top edge 72 of the panel 70 so that the top edge 72 of the panel 70 will snugly receive the car top 36, as described hereinafter.

Additional regions of increased thickness t may be formed along the top and bottom edges 62, 64, 72, 74 of the respective panels 60, 70 by vertical corrugations 69, 69, 79, 79 spaced along the panels 60, 70.

The top 36 is a rectangular panel 80 having a front edge 82, a rear edge 84, two side edges 86, 88, a width W and a depth D. The rear edge 84 and the two side edges 86, 88 are folded up to form three sides 90–92 of an upwardly-facing open box-like structure , as shown, with the opening facing upwardly as shown.

Each of the three sides 90–92 of the top panel 80 form one leg of a U-shaped channel 90*a*, 91*a*, 92*a* that projects at a right angle outwardly a distance t from the respective side 90–92, and thence at right angles downwardly. Thus, the top panel 36 may be fitted snugly over the side panels 30, 32, 34; the channel 91*a* receiving the top edge 52 of the back panel 50, the channel 90*a* receiving the top edge 62 of the side panel 60, and the channel 92*a* receiving the top edge 72 of the side panel 70. This stabilizes the car structure, and all that remains is to clamp the top panel 36 down onto the back and side panels 30, 32 and 34.

Clamping the top panel to the car assembly is the single assembly operation performed outside of the car and simply comprises applying a suitable spreading force between the car frame brackets 24 and the top panel 36. For this purpose, recesses 94 are formed along the side edges 90, 92 of the top panel 36 by the spaced-apart corrugation 96 formed across the width of the exterior surface of the panel 80. The spreading force is readily applied by clamp assemblies 100 comprising blocks 102 that fit within the recesses 94, threaded shafts 104 extending upward from the blocks 102 through holes 106 in the brackets 24, and nuts 108 for applying a spreading force between the brackets 24 and the car top 36.

I claim:

1. An elevator car (26) having two side panels (60;70), a back panel (50), a base panel (38), and a top panel (80), characterized in that:

the base panel (38) has U-shaped channels (41*a*,42*a*,43*a*) of width t extending around its two side edges (45,47) and its back edge (46);

the side panels (60;70) have regions (66*a*;76*a*) of thickness t extending along their back edges (66;76), regions (66*a*,68*a*,69; 76*a*,78*a*,79) of thickness t disposed along their top edges (62;72), and regions (66*a*,68*a*,69; 76*a*, 78*a*,79) of thickness t disposed along their bottom edges (64;74);

the back panel (50) has U-shaped channels (56*a*,58*a*) of width t extending along its side edges (56,58), regions (56*a*,58*a*) of thickness t disposed along its top edge (52), and regions (56*a*,58*a*) of thickness t disposed along its bottom edge (54);

the top panel (80) has U-shaped channels (90*a*,91*a*,92*a*) of width t extending around its two side edges (90,92) and its back edge (91);

the regions (66*a*,68*a*,69; 76*a*,78*a*,79) of thickness t disposed along the bottom edges (64;74) of the side panels (60;70) and the regions 56*a*,58*a*) of thickness t displaced along the bottome edge (54) of the back panel (50) fit snugly within the U-shaped channels (41*a*,42*a*,43*a*) extending around the two side edges (45 47) and back edge (46) of the base panel (38);

the regions (66*a*;76*a*) of thickness t extending along the back edges (66;76) of the side panels (60;70) fit snugly within the U-shaped channels (56*a*,58*a*) along the side edges (56,58) of the back panel (50);

the regions (66*a*,68*a*,69; 76*a*,78*a*,79) of thickness t disposed along the top edges (62;72) of the side panels (60;70) and the regions (56*a*,58*a*) of thickness t disposed along the top edge (52) of the back panel (50) fit snugly within the U-shaped channels (90*a*,91*a*,92*a*) extending around the two side edges (90,92) and back edge (91) of the top panel (80);

the regions (66*a*;76*a*) of thickness t along the back edges (66;76) of the side panels (60;70) are U-shaped channels; and the elevator car being mounted in a car frame (10) having two spaced-apart vertical beams (12,14) disposed on either side of the car (26) and two spaced-apart horizontal beams (20,22) disposed beneath the car (26), characterized in that:

two tabs (48) extend downward from the base panel (38) and fit snugly in the space between the spaced-apart horizontal beams (20,22).

2. An elevator car and associated car frame according to claim 1, characterized in that:

two brackets (24,24) extend inwardly from each spaced-apart vertical beam (12,14) at a position above the top panel (80) of the car (26); and clamping means (100,100) exert a spreading force between the brackets (24,24) and the top panel (80) of the car (26) to rigidize the assembly of panels (38,50,60,70,80).

* * * * *